US005812737A

United States Patent [19]

Wang

[11] Patent Number: 5,812,737

[45] Date of Patent: Sep. 22, 1998

[54] HARMONIC AND FREQUENCY-LOCKED LOOP PITCH TRACKER AND SOUND SEPARATION SYSTEM

[75] Inventor: Avery Wang, Redwood City, Calif.

[73] Assignee: The Board of Trustees of the Leland Stanford Junior University, Palo Alto, Calif.

[21] Appl. No.: 369,804

[22] Filed: Jan. 9, 1995

[51] Int. Cl.[6] ..... G10L 9/04

[52] U.S. Cl. ..... 395/2.16; 395/2.18

[58] Field of Search ..... 395/2, 2.16, 2.18, 395/2.7; 381/38, 39, 49, 50; 364/724.17, 724.19

[56] References Cited

U.S. PATENT DOCUMENTS

| | | | |
|---|---|---|---|
| 3,978,287 | 8/1976 | Fletcher et al. | 395/2.4 |
| 4,004,096 | 1/1977 | Bauer et al. | 395/2.16 |
| 4,486,900 | 12/1984 | Cox et al. | 395/2.16 |
| 4,523,328 | 6/1985 | Kasperkovitz | 381/3 |
| 4,890,071 | 12/1989 | Curtis | 331/11 |
| 5,157,623 | 10/1992 | Hayashi | 364/724.17 |
| 5,285,475 | 2/1994 | Kurokami | 364/724.19 |
| 5,353,372 | 10/1994 | Cook et al. | 395/2.16 |

OTHER PUBLICATIONS

"On Separating Voiced–speech into Its Components"; R. Kumaresan et al.; 27th Asilomar Conference on Signals, Systems & Computers; Nov. 1–3, 1993; vol. 1–2; IEEE pp. 1041–1046.

"Voiced–speech Analysis Based on the Residual Interfering Signal Canceler (RISC) Algorithm"; C.S. Ramalingam et al.; IEEE Intl. Conf. on Acoustics, Speech, and Signal Processing; Apr. 1994; pp. I–473–I–476.

"RISC: An Improved Costas Estimator–Predictor Filter Bank for Decomposing Multicomponent Signals"; R. Kumaresan et al.; To appear in Proc. Seventh SSAP Workshop; Quebec City, Jun. 26–29, 1994; 4 pages.

*Primary Examiner*—David D. Knepper

*Attorney, Agent, or Firm*—Gary S. Williams; Flehr Hohbach Test Albritton & Herbert LLP

[57] ABSTRACT

A quasi periodic signal is frequency warped by selectively frequency modulating it, thereby resulting in a signal that is stationary with a simplified spectrum which is more amenable to analysis. The resultant demodulated signal is low pass filtered resulting in an analytic signal whose phase winding rate is the frequency of the signal. The phase is differenced by multiplying the signal with a delayed version of itself creating an instantaneous autocorrelation. Thereafter the phase difference is measured with a complex arctangent to yield a resulting phase error. The resulting phase error is integrated by an integrator whose output value is the estimate of the frequency. This output frequency parameter is then used to update the demodulating signal thus closing the signal loop. In a second embodiment, a plurality of frequency locked loop trackers are servoed together centering each one of the trackers on a multiple of the fundamental frequency of the input signal. The resulting phase errors derived from the frequency lock loop trackers are weighted to improve system performance. The frequency corrections from each tracker are weighted with the inverse variance of its tracking performance. Accordingly, harmonics with low variance are weighted strongly, and harmonics in a noisy region of the spectrum and thus high variance will be weighted less strongly. The resulting fundamental frequency estimate is a minimum-variance, and is better than the best signal frequency locked loop estimate. The weighted phase error is then fed back to an integrator to yield a high resolution estimate of the target signal frequency. The amplitude envelopes for each partial signal can be easily extracted and used in conjunction with the fundamental estimate from each frequency lock loop tracker to resynthesize the signal in isolation from the mixture.

36 Claims, 9 Drawing Sheets

HARMONIC AND FREQUENCY-LOCKED LOOP PITCH TRACKER AND SOUND SEPARATION SYSTEM

The present invention relates generally to pitch tracking systems, methods for tracking the pitch of a quasi periodic sound source and for the separation of periodic signals from mixtures of sounds.

BACKGROUND OF THE INVENTION

Pitch tracking is of interest whenever a single quasi periodic sound source is to be studied or modeled. For instance, the trajectory of a sound's pitch, also called the fundamental frequency, over a period of time can also be used to synthesize similar or related sounds using speech or musical synthesis techniques. An example of a quasi periodic sound source is a singer's voice singing a particular note (e.g., high C). The sound generated by the singer typically has a certain amount of vibrato or pitch modulation, noise and aperiodicity in the wave shape, making the sound quasi periodic rather than a pure periodic signal.

Currently pitch detection methods can be classified into three categories: Fourier-based frequency domain techniques, time domain techniques, and methods which use both techniques. The present invention is a time domain technique.

In time domain "feature detection methods", the input signal is usually preprocessed to accentuate some time domain feature, and the time between occurrences of that feature is calculated as the period of the signal. The pitch and the period of the input signal are related by the equation: pitch=1/period. A typical time domain feature detector includes a low pass filter for detecting peaks or zero crossings of the filtered signal. Since the time between occurrences of a particular feature is used as the period estimate, feature detection schemes usually do not use all of the data available. Selection of a different feature often yields a different set of pitch estimates. Since estimates of the period are often defined at the instant when the features are detected, the frequency samples yielded are not uniformly distributed in time. To avoid the problem of non-uniform time sampling, a window of fixed sized can be moved through the signal in order to obtain an averaged period estimate.

Other prior art time domain methods include the use of auto correlation functions or difference norms to detect the similarity between the wave form and a time lag version of itself. However, prior art methods were computationally inefficient, with real time performance infeasible.

SUMMARY OF THE INVENTION

In summary, the present invention is a system and method for tracking the pitch of a quasi periodic signal in a mixture of signals. The quasi periodic signal is "frequency warped" by selectively frequency modulating it, thereby resulting in a signal that is stationary and is a simplified spectrum which is more amenable to analysis. The resultant demodulated signal is low pass filtered resulting in an analytic signal whose phase winding rate is the frequency mismatch error between the target signal and the demodulating signal. The phase is differenced by multiplying the signal with a delayed version of itself creating an instantaneous autocorrelation. Thereafter the phase difference is measured with a complex arctangent to yield a resulting phase error. The resulting phase error is input to an integrator whose output value is the estimate of the frequency. This output frequency parameter is then used to update the demodulating signal thus closing the signal loop.

In a second embodiment of the present invention, a plurality of frequency locked loop trackers are servoed together centering each one of the trackers on a multiple of the fundamental frequency of the input signal. The resulting phase errors derived from the frequency lock loop trackers are weighted to improve system performance. In one embodiment, the frequency corrections from each tracker are weighted with the inverse variance of its tracking performance. Accordingly, harmonics with low variance are weighted strongly, and harmonics in a noisy region of the spectrum and thus high variance will be weighted less strongly. The resulting fundamental frequency estimate is a minimum-variance estimate, and is better than the best single frequency locked loop estimate. The weighted phase error is then fed back to an integrator to yield a high resolution estimate of the target signal fundamental frequency and all of its harmonics. The amplitude envelopes for each partial signal can be easily extracted and used in conjunction with the fundamental estimate from each frequency lock loop tracker to resynthesize the signal in isolation from the mixture. Since the resynthesized signal is in phase with the original signal, the target may be removed from the mixture by subtraction.

BRIEF DESCRIPTION OF THE DRAWINGS

Additional objects of interest to the invention will be more readily apparent from the following description and appended claims when taken in conjunction with the drawings, in which:

DESCRIPTION OF THE PREFERRED EMBODIMENTS

Figure 1:
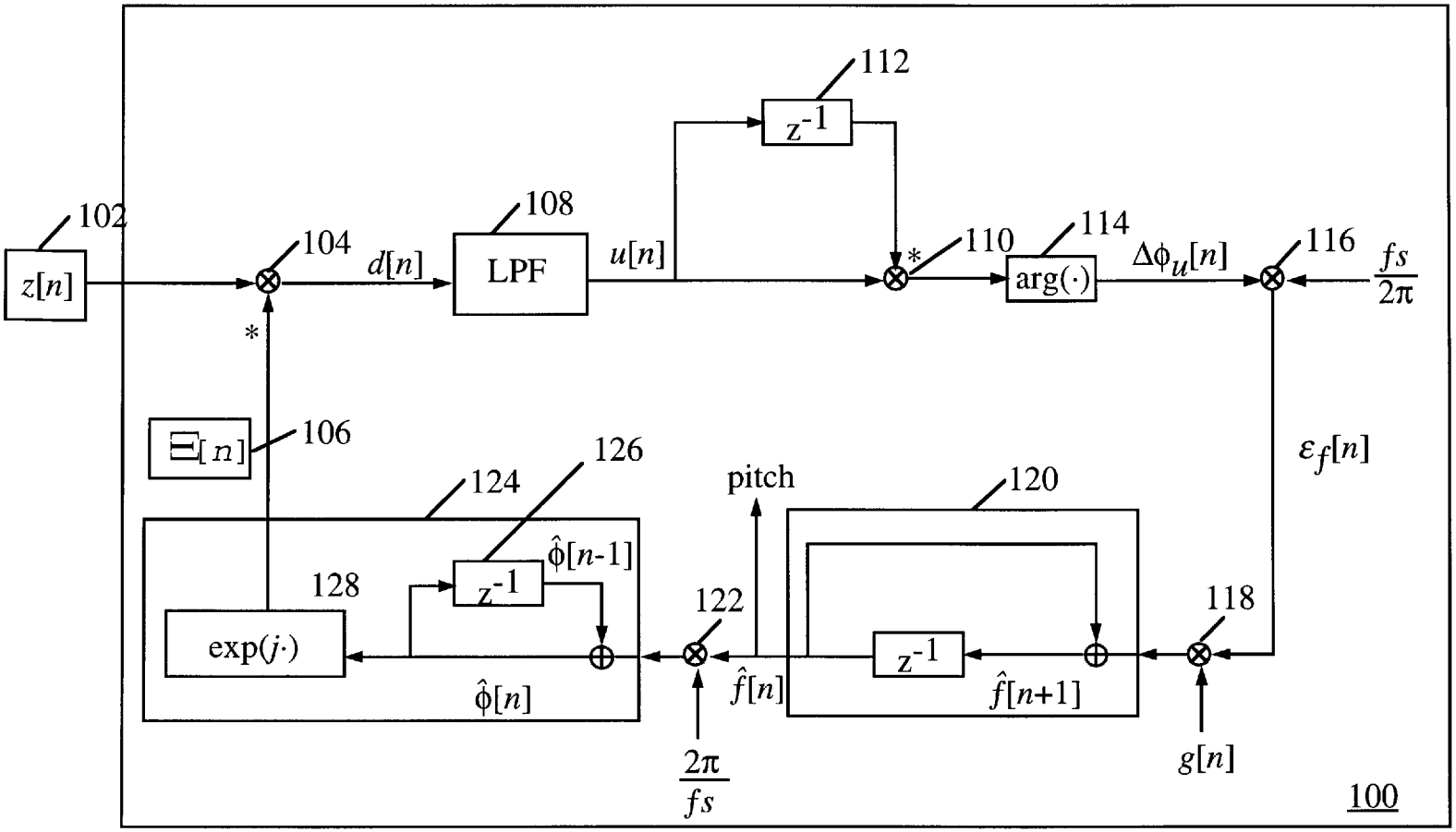
FIG. 1 is a frequency locked loop tracker according to the preferred embodiment of the present invention.

Referring to FIG. 1, the pitch track of the present invention 100 is shown. The pitch tracker 100 receives as an input signal z[n] 102 which is a mixture of a p[n] complex valued discrete time signal and some unknown disturbance signal v[n] wherein $$z[n]=p[n]+v[n]$$

The target signal p[n] is a complex value discrete time signal defined for n >0 with a sampling frequency $f_s$ wherein $$p[n] = a[n]\exp\left(\frac{j2\pi}{f_s}\sum_{k=1}^{n} f[k] + j\phi_0\right)$$

where a[n] is the instantaneous amplitude envelope, f[n] is the instantaneous frequency, and $\phi_0$ is the phase offset at time n=0.

The first step in the analysis of the input signal z[n] 102 is to demodulate the input signal by means of a frequency matched demodulation signal. In particular, the input signal z[n] 102 is demodulated by multiplier 104, which multiplies the input signal z[n] with the complex conjugate of a demodulation signal herein called the a frequency warping signal Ξ[n] 106. The use of the frequency warping signal 106 allows for the elimination of the FM band width component due to the instantaneous frequency modulation of the carrier. The frequency warping signal 106 demodulates the input signal z[n] 102 by means of a signal which is frequency matched to the input signal z[n] 102. In the preferred embodiment of the present invention, the input signal z[n] is demodulated using a complex phasor which rotates at a frequency equal to a frequency estimate generated by the pitch tracker 100. The frequency matching will be described in greater detail below in conjunction with the frequency estimate generated by the pitch tracker of the present invention. For the purposes of this first step of the analysis, it will be assumed that a frequency matched demodulation signal is provided. Those ordinarily skilled in the art will recognize that if the frequency estimate is equal to the target frequency, then the frequency matched demodulation by the instantaneous frequency $f(t)$ of the estimate signal will yield a constant phase signal d[n] at or near DC.

The second step of the analysis requires low pass filtering of the constant phase signal to improve the signal to noise ratio. In particular, the complex demodulated signal d[n] resulting from the multiplication of the input signal z[n] 102 with the complex conjugate of the frequency warping signal 106 is coupled to a low pass filter 108. The low pass filter 108 improves the signal to noise ratio by low pass filtering the demodulated signal d[n] thereby attenuating the demodulated noise portion of the input signal.

In the preferred embodiment of the present invention, the low pass filter has a cut off frequency of $f_c$ and unity gain at DC. The low pass filter may be of time-varying or time-invariant form with a fixed $f_c$. A time-varying filter can be used with a dynamically adjustable bandwidth wherein a wide cut-off frequency is programmed before frequency lock is achieved, and thereafter bandwidth can be reduced. However, dynamically altering the filter characteristics may introduce artifacts into the filter output if changes are made suddenly. Accordingly, in the preferred embodiment of the present invention, a time-invariant filter with a wide bandwidth is utilized providing a wide frequency lock-in range. A typical cut-off frequency would be 50–100 Hz. Wider cut-off frequencies are beneficial for tracking signals with rapidly varying frequency modulation, whereas narrower cut-off frequencies allow for better noise rejection.

In the next step of the analysis, the resultant low pass filtered signal is sampled to measure the phase difference of the filtered signal. The resultant signal u[n] is multiplied by means of multiplier 110 with a delayed and complex-conjugated version of itself via delay line 112. The change in phase of the resultant signal u[n] from the low pass filter 108 is then calculated by using a standard argument function 114 in order to result in the change in phase $\Delta\phi_u[n]$.

The frequency tracking error at time [n] is thereafter defined as $\epsilon_f[n]$ where $$\epsilon_f[n] = \frac{f_s}{2\pi}\,\Delta\phi_u[n]$$

Accordingly the change in phase $\Delta\phi_u[n]$ is normalized by multiplying the change in phase signal by the sampling frequency divided by $2\pi(f_s/2\pi)$ by multiplier 116 and results in an instantaneous frequency tracking error at time [n]. Note that the scaling factor may be left off resulting in calculations in radians per sample as opposed to hertz. In the preferred embodiment of the present invention the sampling frequency is 44,100 Hz, however, other sampling frequencies as is known in the art may be utilized. The frequency tracking error represents the error between the frequency estimate (generated by the pitch tracker 100 for use in demodulating the input signal z[n]) and the frequency of the target signal p[n].

Having calculated the frequency tracking error, the pitch tracker 100 utilizes this error information to generate a better frequency estimate for use in demodulating the input signal. Specifically, the frequency tracking error $\epsilon_f[n]$ is combined with an attenuation tracking gain signal g[n] by multiplier 118 for input into integrator 120. The gain signal g[n] controls how fast the system will adapt to the particular frequency error $\epsilon_f[n]$. The combination of the frequency error $\epsilon_f[n]$ and the gain signal g[n] yields an attenuated frequency error signal. The attenuated frequency error signal is coupled to an integrator 120 in order to derive the estimated frequency output $\hat{f}[n]$ for use in updating the demodulation signal. Those ordinarily skilled in the art will recognize that any filtering or smoothing means may be used as is known in the art in lieu of the simple attenuated frequency integrator. In the preferred embodiment the integrator output, which reflects the estimated frequency of the target signal, must be initialized for tracking a particular desired partial signal. This may be accomplished by providing a particularized user input associated with the frequency of a particular partial signal to be tracked or may be accomplished by performing a sweep over an audio band in order to isolate a particular partial signal. Alternatively, a peak-detection scheme may be used on a FFT of an initial segment of the input signal to find a candidate initial frequency. Those ordinarily skilled in the art will recognize that the frequency tracker 100 will naturally track the strongest sinusoidal in the pass band of the low pass filter, and accordingly, the accuracy of the initial frequency estimate is not critical.

Finally the loop is closed by providing the frequency estimate to a phase accumulator for updating the frequency warping signal for use in demodulating the input signal. Specifically, the integrator estimated frequency output $\hat{f}[n]$ from integrator 120 is scaled via multiplier 122 by combining the estimated frequency with a scaling signal ($2\pi/f_s$ where $f_s$ is the sampling frequency). The scaled output is coupled to a phase accumulator 124 for use in deriving an estimated phase responsive to the estimated frequency $\hat{f}[n]$. The estimated phase is then used as the estimated phase of the demodulating phasor to produce the warping signal 106 for use in the demodulation of the input signal z[n]. The phase accumulator 124 includes an integrator 126 which derives an estimated phase from the scaled estimated frequency provided from the integrator 120. The derived phase is the estimated phase of the demodulating phasor for use in demodulating the input signal z[n]. In the preferred embodiment, this is accomplished by transforming the estimated phase into a sinusoid by taking the cosine and sine of the phase to generate a complex sinusoidal signal using exp (j•) function 128. Additionally, the phase is wrapped in a periodic fashion in order to prevent overflow of the phase accumulator 124.

Those ordinarily skilled in the art will recognize that the combination of the output estimate frequency from the integrator 120 in conjunction with the scaling multiplier 122 and the modulator 124 for deriving a frequency warping signal 106 is equivalent to a voltage controlled oscillator wherein the input frequency is used to derive a frequency matched demodulation signal. As such, the description of the integrator and phase accumulator according to the preferred embodiment should not be construed as limiting.

Figure 2:
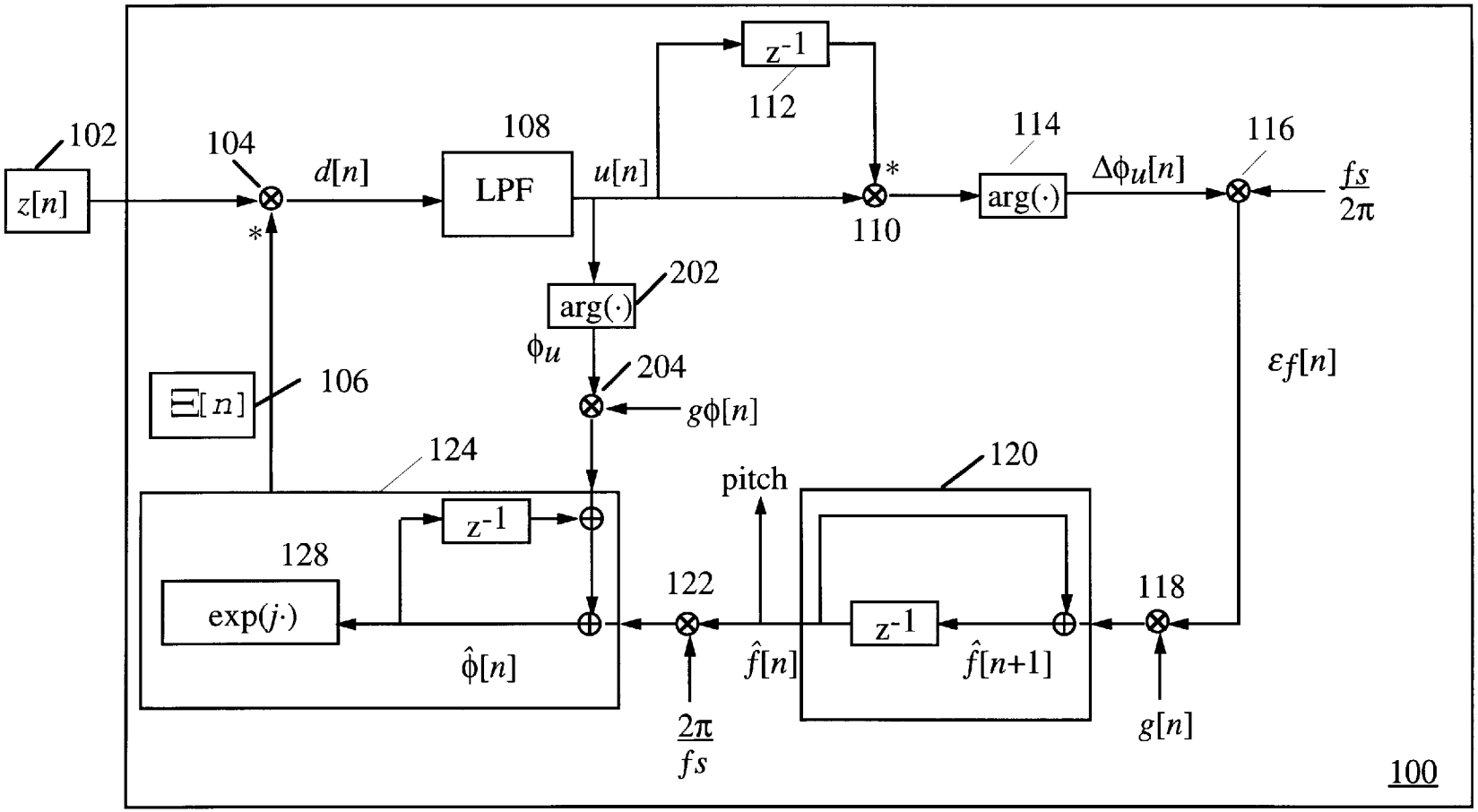
FIG. 2 shows the frequency locked loop tracker of FIG. 1 including a phase locked loop.

Referring now to FIG. 2, the frequency locked loop tracker of the present invention is shown including a phase-locked loop for more feedback control. In this embodiment, a phase-locked loop is provided for locking to the phase of the demodulated and filtered signal u[n] described in conjunction with the first embodiment above. In the preferred embodiment described above, the frequency of a target signal is tracked but the phase is not. By providing a phase-lock feedback term, phase lock as well as frequency lock may be attained. The extra phase information provides for better isolation of the target signal for subtractive analysis. In this embodiment, the pitch tracker is more sensitive to noise and phase locking is difficult to attain in rapidly changing signals. Again, the analysis begins by demodulating a complex input signal z[n] 102 via multiplier 104 by a frequency warping signal 106 resulting in the complex demodulated signal d[n]. The complex demodulated signal d[n] is coupled to a low pass filter 108 producing an analytic output u[n].

The analytic signal u[n] is used in achieving phase lock by adding a modification to the frequency lock method described in the preferred embodiment. The phase lock loop is created by providing a second loop for tracking the phase mismatch error between the frequency warping signal 106 and the input signal z[n] 102. This is accomplished by taking the argument 202 of the analytic signal u[n] which yields a phase error. The resultant phase error is attenuated by a phase gain signal $g_\phi[n]$ via multiplier 204. The resultant attenuated phase error signal is coupled to the phase accumulator 124 of the preferred embodiment. Internal to the phase accumulator 124, this attenuated phase error is combined via an internal integrator with the derived phase estimate for phase lock. Those ordinarily skilled in the art will recognize that there are now two competing forces trying to guide the tracking. Close attention must be paid to the relative ratios of the gain $g_n$ and the phase gain $g_\phi[n]$ since both phases range over $[-\pi, \pi]$. Accordingly, g[n] must be much greater than $g_\phi[n]$. However, as frequency lock is obtained, the phase gain $g_\phi[n]$ can be varied to be large enough to ensure that quick phase tracking convergence occur. Those ordinarily skilled in the art will recognize that automatic gain control algorithms which track the status of the frequency lock can adjust the gain g[n] and phase gain $g_\phi[n]$ making them dependant on the variances in the phase difference $\Delta\phi_u[n]$ and the phase mismatch error $\phi_u$.

Figure 3:
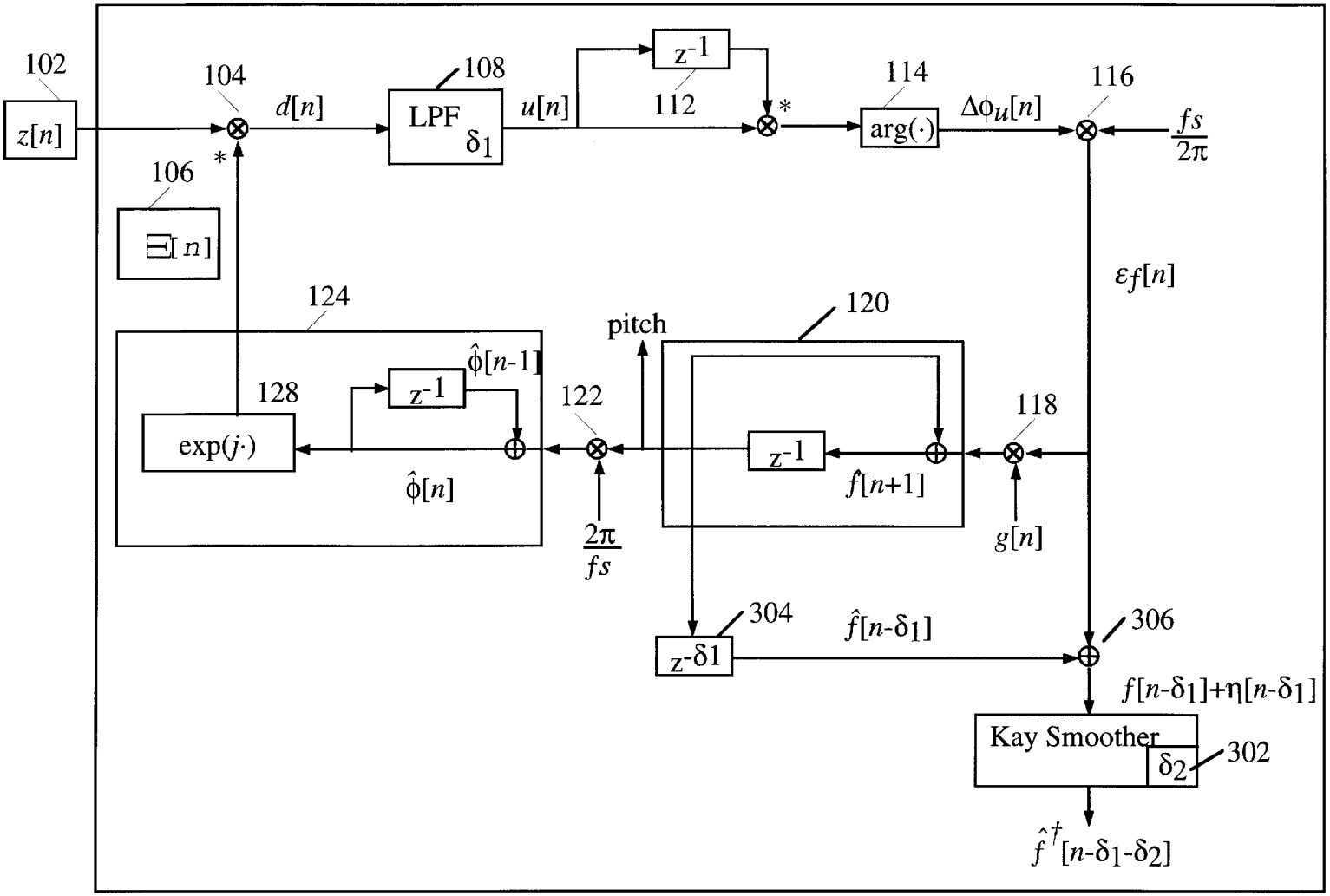
FIG. 3 shows the frequency locked loop tracker of FIG. 1 including an improved frequency estimation means outside the tracking loop.

Referring now to FIG. 3, the present invention is shown including a second frequency estimate $\hat{f}^{+}[n-\delta 1-\delta 2]$ for providing a frequency estimate including group delay compensation outside the "loop" for use in resynthesis or other means as is known in the art. The basic tracking loop is identical to that shown in FIG. 1, however, a second frequency estimate is made outside of the loop based on the crude estimates of $\hat{f}[n]$ from a first pass of a partial signal to be tracked along with the error estimation updates $\epsilon_f[n]$. The crude estimates are then refined using a Kay optimal phase-difference smoother.

Specifically, the estimated frequency $\hat{f}[n]$ output from the integrator 120 is coupled via a delay line 304 to the frequency error signal $\epsilon_f[n]$ via adder 306. Since the new estimate is made outside the loop, the new estimate does not contribute to tracking dynamics. The group delay of the low pass filter 108 is taken into account by the delay line 304. The output of the adder 306, which is effectively the phase difference of the input signal if it had not been demodulated by the frequency warping signal 106, is then coupled to a Kay smoother 302 having a group delay of δ2. In the preferred embodiment, the Kay smoother 302 is simply an FIR filter with quadratic coefficients given by the formula $$w_{kay}[n] = \frac{6N}{N^2-1}\left\{\frac{n}{N} - \left(\frac{n}{N}\right)^2\right\}$$

for $1<n\leqq N-1$. The Kay smoother output then reflects an improved estimate of the frequency being tracked. This improved estimate $\hat{f}^{+}[n-\delta 1-67\ 2]$ may be used in providing a resynthesized partial signal as will be described below.

Figure 4:
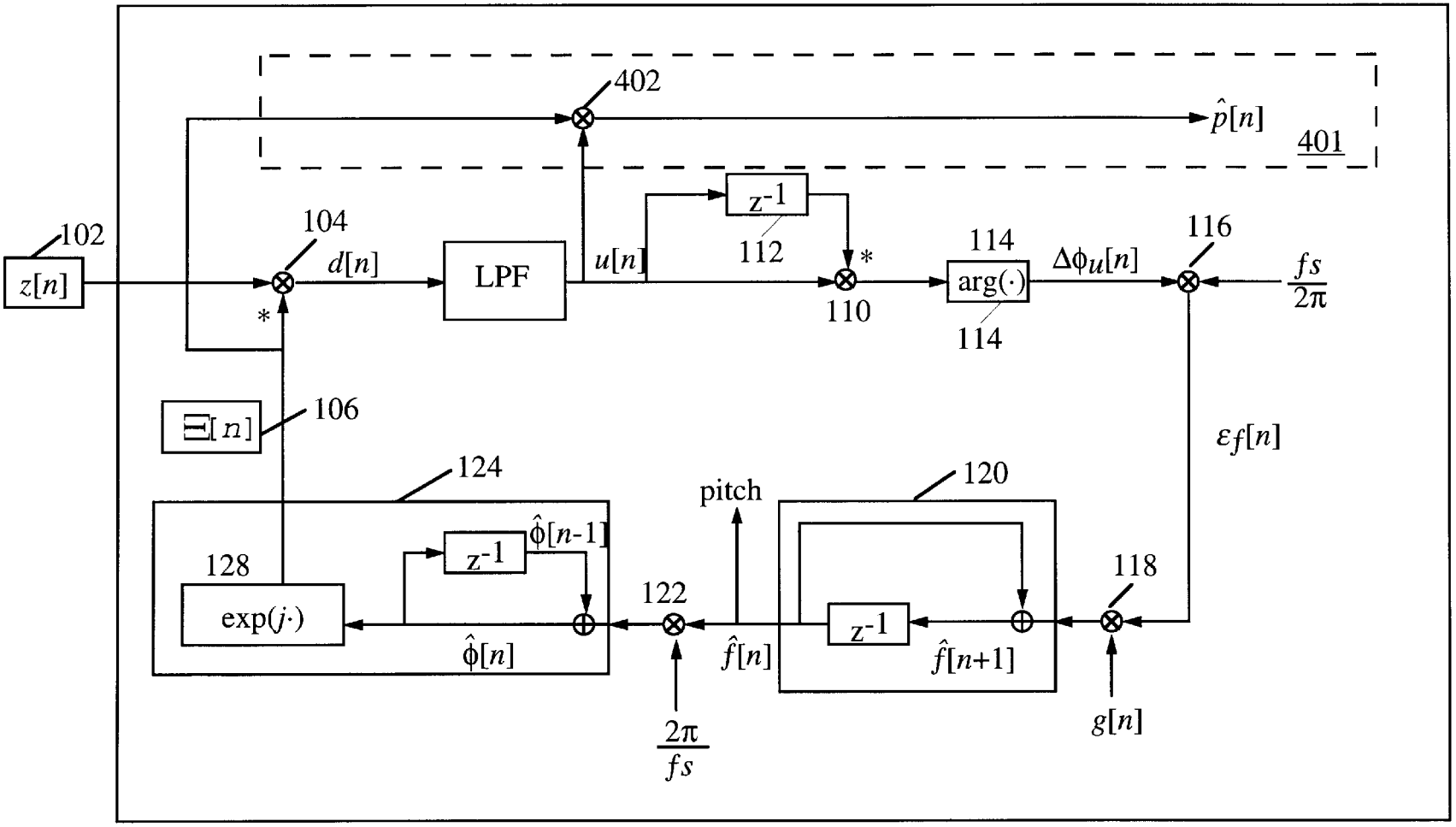
FIG. 4 is a frequency locked loop tracker according to the preferred embodiment of the present invention including a resynthesis module.

Referring now to FIG. 4, the frequency locked loop tracker 100 of the preferred embodiment of the present invention is shown including a resynthesis module 401. Often it may be desired to produce a resynthesized partial signal $\hat{p}[n]$ which is a cleaned up version of the partial signal p[n] being tracked from the input signal z[n]. The cleaned up signal may be derived by combining the frequency warping signal 106 with the analytic signal u[n] via multiplier 402. The resultant output of this combination is an estimated partial signal $\hat{p}[n]$ which reflects the combination of the estimated frequency from the integrator 120 (as embodied in the frequency warping signal 106) combined with the envelope signal u[n].

Figure 5A:
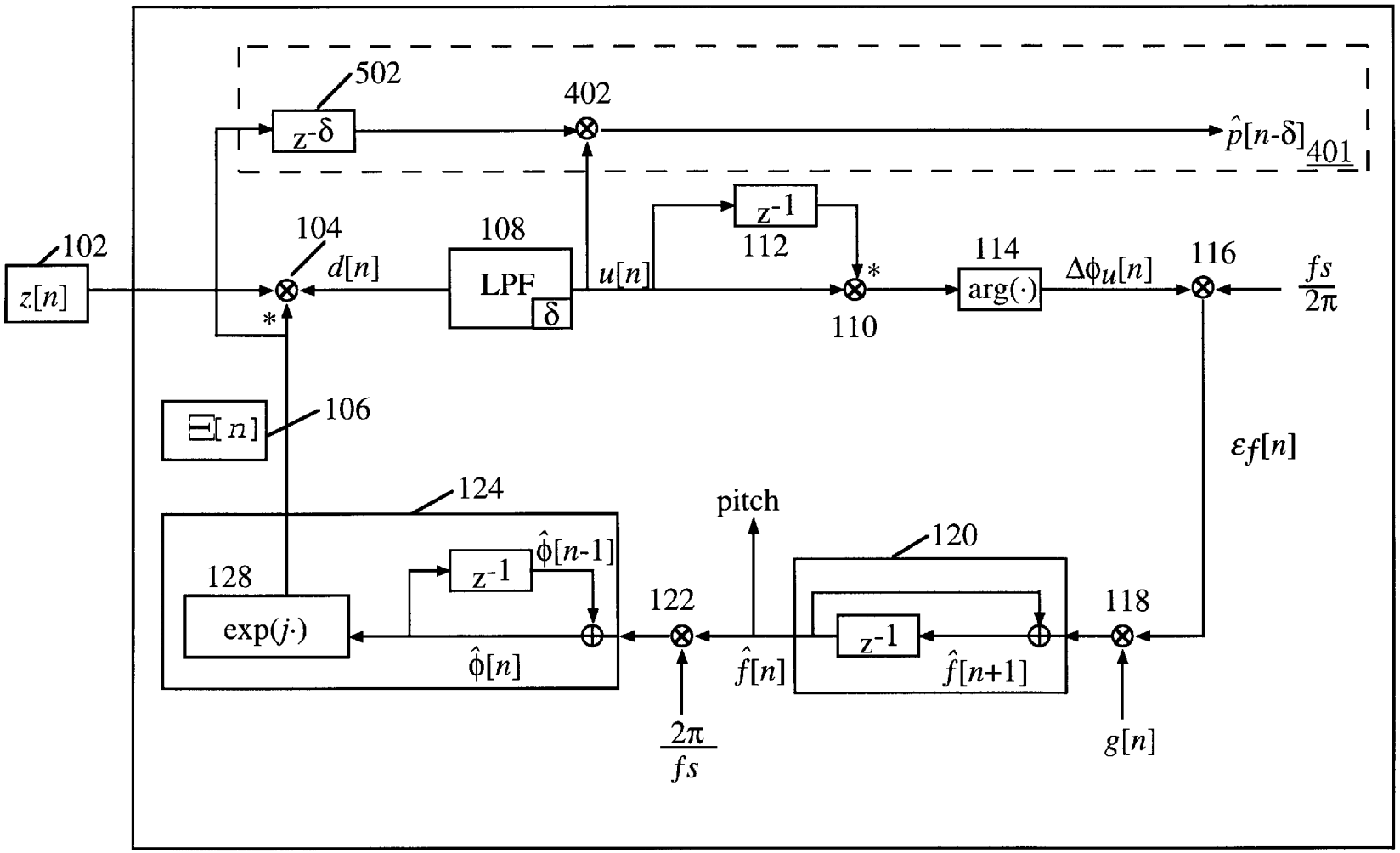
FIG. 5A shows the frequency locked loop tracker of FIG. 4 including a delay line for compensating for the low pass filter group delay.

Those ordinarily skilled in the art will recognize that this frequency locked loop tracker does not compensate for the group delay of the low pass filter 108. A better estimation of the partial signal $\hat{p}[n-\delta_1]$ can be derived by providing a delay line 502 as shown in FIG. 5A. The delay line 502 provides compensation for the group delay of the low pass filter and accordingly provides a more accurate resynthesized partial signal. Specifically, the delay line 502 couples the frequency warping signal 106 to the multiplier 402 yielding an improved estimate that accounts for the group delay of the low pass filter.

Figure 5B:
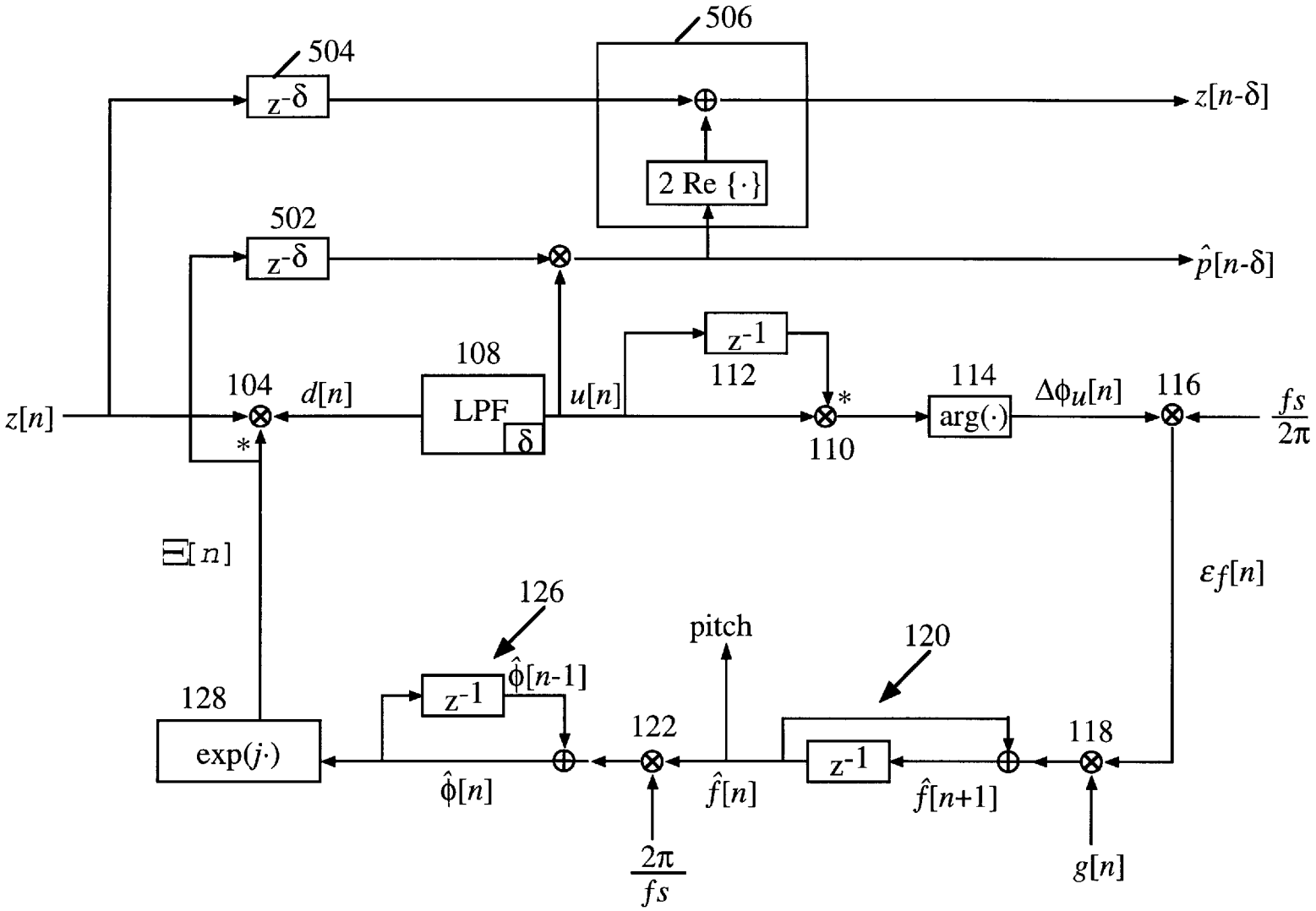
FIG. 5B shows the frequency locked loop tracker of FIG. 5A including a subtraction module for removing the resynthesized partial signal from the input signal.

In addition to the isolation of a particular partial signal from a given input signal as described above, it is often desirous to produce a filtered input signal which has had the target signal removed. Examples of applications where this may be used is in the removal of a "voice" or musical instrument from a musical selection (e.g. audio signal) or the removal of background noise from a "voice". This process is known as notch-filtering, and when applied will result in a notch-filtered output signal. In the preferred embodiment, the partial signal p[n] or $\hat{p}[n-\delta_1]$ may be used in a notch-filter process to derive a notch-filtered output signal as shown in FIG. 5B. The notch-filtered output signal is derived by subtracting the resynthesized partial signal p[n] from the input signal z[n]. In the preferred embodiment, the input signal z[n] is coupled via a second delay line 504 to a first input of a subtractor 506. The second input of the subtractor 506 receives the resynthesized partial signal $p[n-\delta_1]$ from above. The subtractor 506 outputs a notch-filtered signal resulting from the subtraction of the partial signal from the input signal.

Figure 6A:
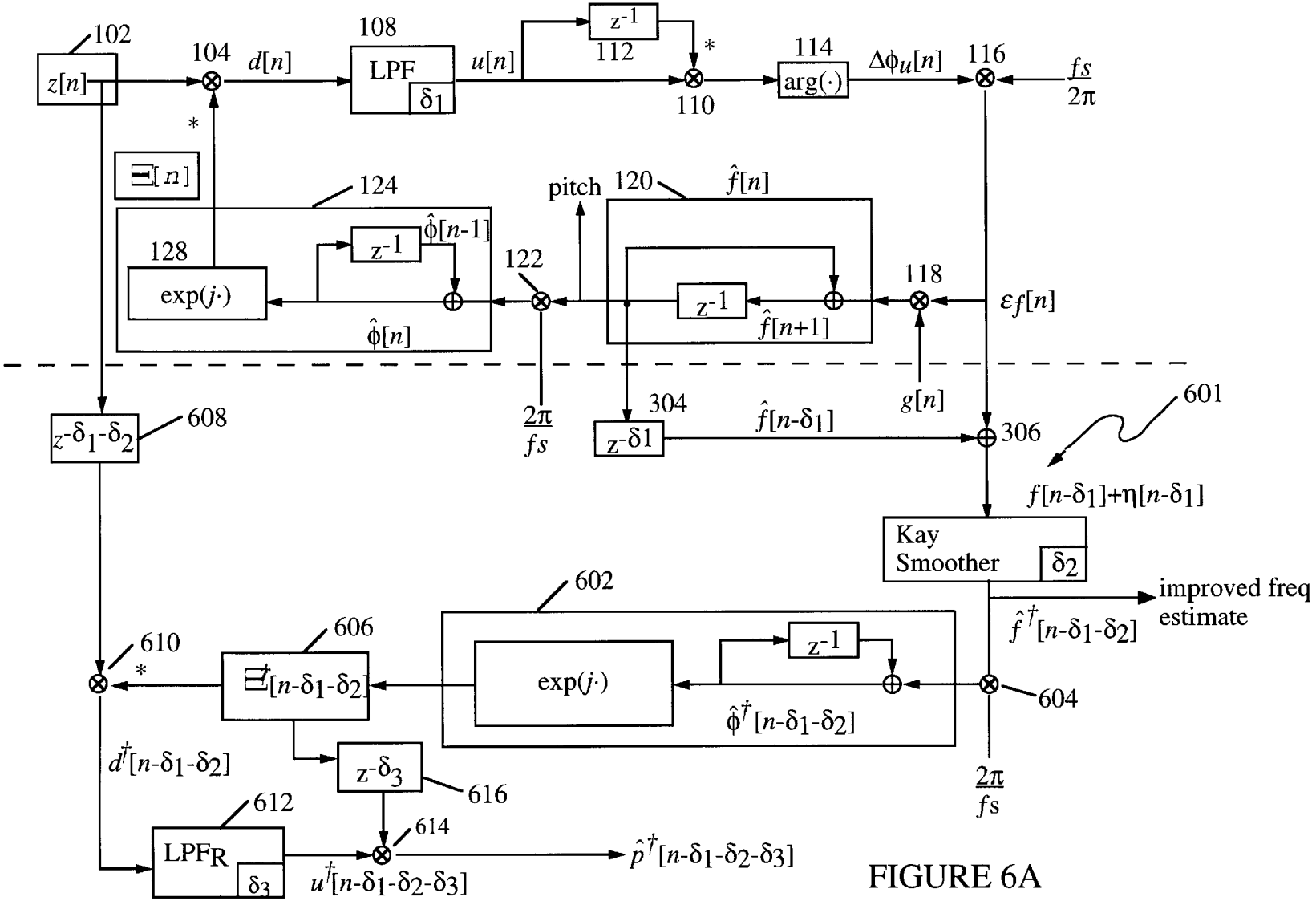
FIG. 6A is a frequency locked loop tracker according to FIG. 3 including a resynthesis module.

Referring now to FIG. 6A, a second resynthesis module 601 for resynthesizing a partial signal is shown. The basic frequency locked loop tracker of FIG. 1 is included with the Kay smoother filter 302 of FIG. 3 in order to make use of the improved frequency estimate $\hat{f}^{\dagger}[n-\delta_1-\delta_2]$ in producing a resynthesized partial signal. Specifically, the improved frequency estimate $\hat{f}^{\dagger}[n-\delta_1-\delta_2]$ is scaled by combining it with a scaling signal ($2\pi/f_s$ where $f_s$ is the sampling frequency) via multiplier 604. The scaled frequency is then coupled to a second phase accumulator 602 which integrates the scaled frequency to create an improved estimated phase of the demodulating phasor for the phase accumulator 602. The phase accumulator 602 outputs a second frequency warping signal 606 which is utilized in demodulating a delayed version of the input signal $z_n$. This is accomplished by coupling the input signal $z_n$ via delay line 608 to multiplier 610 for combining with the second frequency warping signal 606.

The complex demodulated signal $d^{\dagger}[n-\delta_1-\delta_2]$ is then coupled to a second low pass filter 612 having a group delay of δ3. The output of the second low pass filter 612 is coupled with the second frequency warping signal 606 via multiplier 614 in order to yield an improved partial signal $\hat{p}^{\dagger}[n-\delta 1-\delta 2-\delta 3]$. The second low pass filter is the resynthesis filter, and is designed to allow for higher-quality filtering characterized by a narrower cut-off frequency and linear phase response. Those ordinarily skilled in the art will recognize that a delay line 616 may be used to couple the second frequency warping signal 606 to the multiplier 614 in order to account for the group delay of the second low pass filter 612. Accordingly, the resultant output of the combination of the delayed second frequency warping signal 606 and the analytic signal from the low pass filter 612 will result in an improved partial signal $\hat{p}^{\dagger}[n-\delta_1-\delta_2-\delta_3]$. Because this resynthesized signal is generated outside the normal tracking loop, no tracking dynamics will be affected by this resynthesis function. Those ordinarily skilled in the art will recognize that the more efficient estimate of the partial signal $\hat{p}[n]$ can be used to calculate a high quality notched filter signal as is known in the art.

Figure 6B:
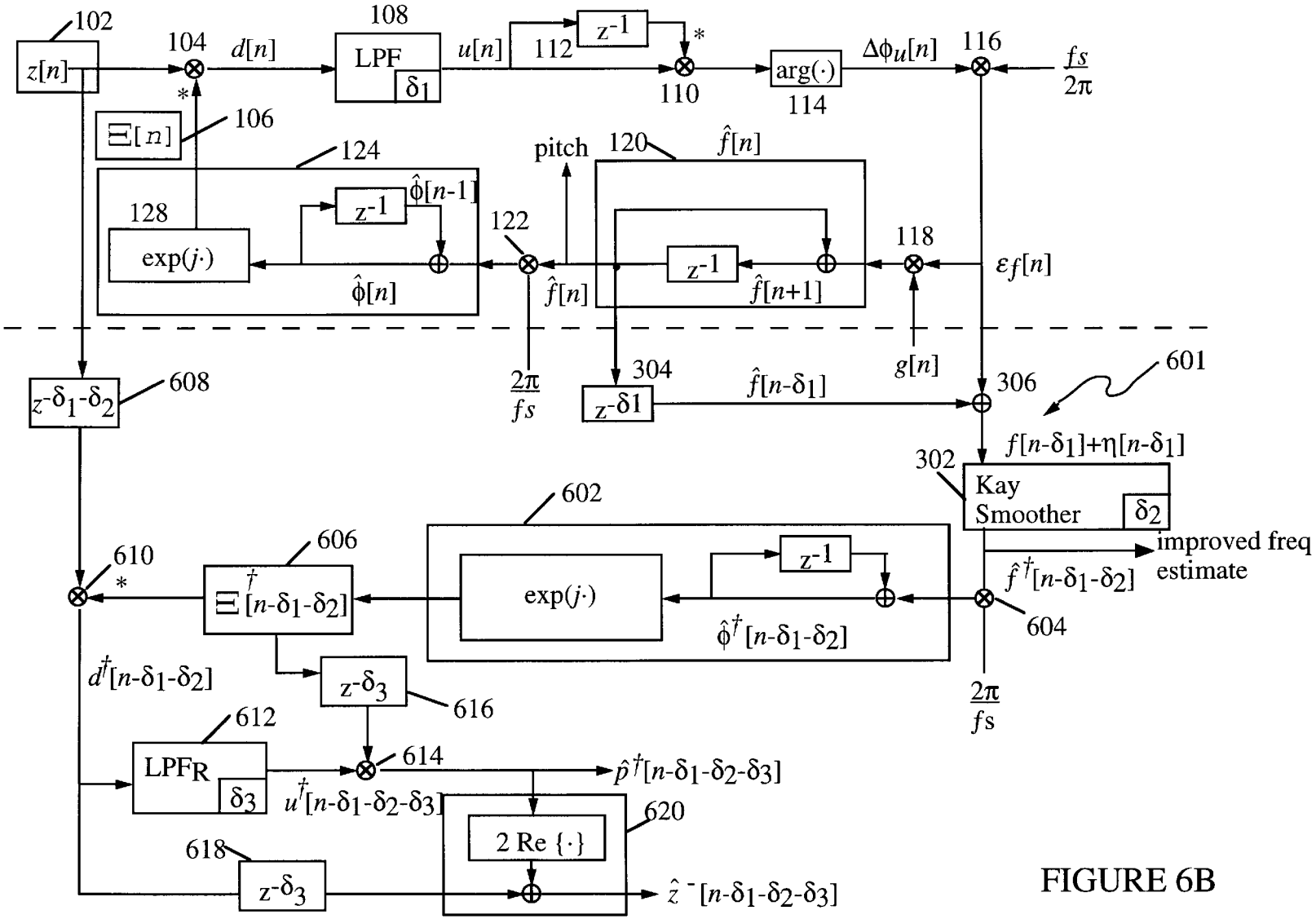
FIG. 6B shows the frequency locked loop tracker of FIG. 6A including a subtraction module for removing the resynthesized partial signal from the input signal.

Again, the partial signal $\hat{p}[n-\delta_1-\delta_2-\delta_3]$ may be used in a notch-filter process to derive a notch-filtered output signal as shown in FIG. 6B. The notch-filtered output signal is derived by subtracting the resynthesized partial signal p[n] from the input signal z[n]. In the preferred embodiment, the input signal z[n] is coupled via a fourth delay line 618 to a first input of a subtractor 620. The second input of the subtractor 620 receives the resynthesized partial signal $\hat{p}[n-\delta_1-\delta_2-\delta_3]$ from above. The subtractor 620 outputs a notch-filtered signal resulting from the subtraction of the partial signal from the input signal.

Figure 7:
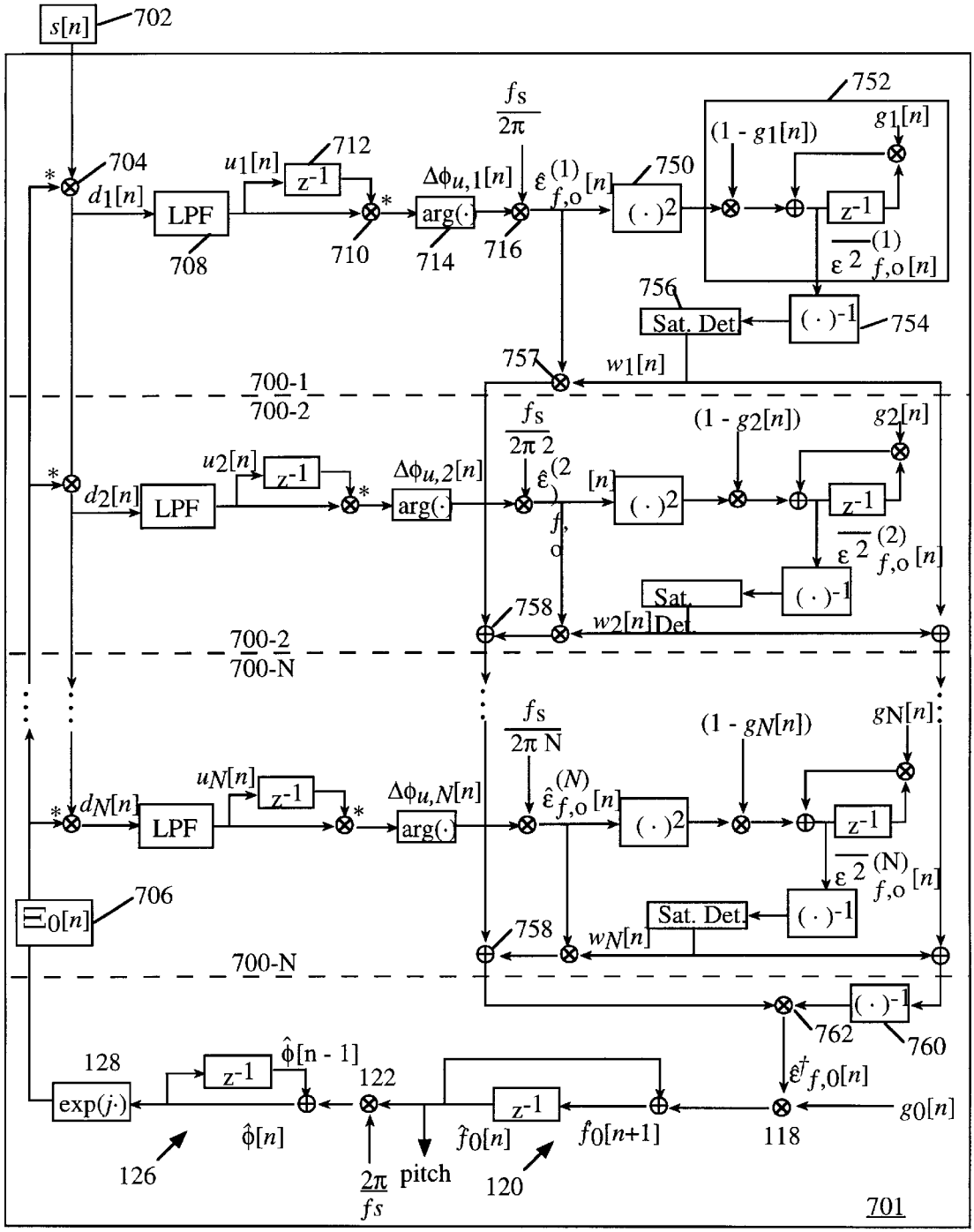
FIG. 7 is a harmonic locked loop tracker in which a plurality of frequency locked loop trackers according to the preferred embodiment of the present invention are servoed for tracking a partial signal and a plurality harmonics of the partial signal.

Referring now to FIG. 7, a plurality of frequency locked loop trackers 700-1 to 700-N according to the preferred embodiment of the present invention are servoed in a harmonic locked loop tracker 701. The frequency locked loop tracker of the preferred embodiment of the present invention performs fast and accurate tracking of the instantaneous frequency of a single target partial signal in isolation. However if the signal to noise ratio is large, tracking may break down. Acoustical signals are often composed of complex mixtures of signals which bring the signal to noise ratio for a target partial signal down below the level needed for tracking according to the frequency locked loop method disclosed above. However, the harmonic structure of many natural acoustic signals allows for the robust tracking of the harmonic set of partials associated with a given harmonic signal. Accordingly, a harmonic locked loop tracker 701 is provided wherein a plurality of frequency locked loop trackers are servoed to track a partial signal and a plurality of harmonics where each of the harmonics is a multiple of the fundamental frequency of the partial signal being tracked.

In the first step of the analysis of a harmonic signal s[n], an instantaneous frequency correction term is calculated for each harmonic. Specifically, the harmonic signal s[n] is demodulated by the frequency warping signal 706 via multipliers 704 for each stage. Each stage further includes a low pass filter 708 which receives the complex demodulated signal $d_k[n]$ which in turn produces an analytic signal $u_k[n]$. This resultant signal $u_k[n]$ is then combined with a conjugate of itself delayed by one sample via multiplier 710 and delay element 712. The resultant output of the multiplier 710 is coupled to a phase extraction module 714 in order to calculate the phase difference of the resultant signal. The phase extraction module 714 is normalized by combining a normalization signal ($f_s/2\pi k$ where $f_s$ is the sampling frequency) via multiplier 716, resulting in a error term $\hat{\epsilon}^{(k)}_{f,o}[n]$. The division by "k" takes into account that the kth stage is tracking "k" times the fundamental frequency.

In the second step of the analysis, the resulting error signals $\hat{\epsilon}^{(k)}_{f,o}[n]$ are combined for each stage to yield an overall optimized error correction for use by the frequency estimator and phase accumulator of the frequency locked loop tracker disclosed above. In the preferred embodiment, the frequency corrections from each tracker are weighted in accordance with the inverse of the variance of its tracking performance. Hence each harmonic of the tracked fundamental signal with a low variance will be weighted strongly, while harmonics with high variance (e.g., in noisy portions of the spectrum) will be weighted less strongly. The resultant fundamental frequency estimate is a minimum variance estimate, and is better than the best single frequency locked loop estimate.

Specifically, the error signal $\hat{\epsilon}^{(k)}_{f,o}[n]$ is utilized in order to calculate a variance estimate for each of the individual phase trackers. In each tracker, the error signal $\hat{\epsilon}^{(k)}_{f,o}[n]$ is multiplied by itself via squaring module 750. The output of the squaring module 750 is coupled to a variance estimator 752 utilized to calculate the variance of the error signal $\hat{\epsilon}^{(k)}_{f,o}[n]$. The variance estimator 752 derives a variance estimate $\hat{\bar{\epsilon}}^{2(k)}_{f,o}[n]$ according to the formula $$\hat{\bar{\epsilon}}^{2(k)}_{f,o}[n]=g_k[n]\hat{\bar{\epsilon}}^{2(k)}_{f,o}[n-1]+(1-g_k[n])(\hat{\epsilon}^{(k)}_{f,o}[n])^2$$

wherein the time constant $g_k[n]$ may be time varying and an exponential weighting scheme is used. Those ordinarily skilled in the art will recognize that other weighting schemes may be utilized in order to determine how the individual phasor signals will be combined in order to optimize partial signal tracking.

In the preferred embodiment of the present invention, the resultant variance estimate $\hat{\bar{\epsilon}}^{2(k)}_{f,o}[n]$ is inverted by module 754 and then coupled to a saturation detector 756. The saturation detector serves to compensate for signals with a high signal to noise ratio for the particular harmonic being tracked. When the signal to noise ratio is too high, the variance estimate becomes limited by the band width of the low pass filter 708 causing it to be too low. When the variance estimate is saturated in this way, it causes the weighting for its associated tracker to be too high. This saturated variance estimate associated with the particular harmonic tracking stage then becomes an unreliable estimator of the true variance of the single target partial p[n] for this particular harmonic. This is especially a problem for higher harmonics where often a mix of broad band noise and audio signals occurs. The weighting given to the particular frequency and phase error associated with the individual harmonic is proportional to the reciprocal of the estimated variance thus not allowing for the higher harmonics to become unfairly highly weighted. In the preferred embodiment, the saturation detector 756 output $w_k[n]$ is defined as $w_k[n]=1/\hat{\bar{\epsilon}}^{2(k)}_{f,o}[n]$ if $\hat{\bar{\epsilon}}^{2(k)}_{f,o}[n]<BW^2/24k^2$ otherwise $w_k[n]=1/k^2\hat{\bar{\epsilon}}^{2(k)}_{f,o}[n]$ where BW equals the bandwidth of the kth low pass filter 708.

The output of the saturation detector is combined via multiplier 757 with the individual error signal $\hat{\bar{\epsilon}}^{(k)}_{f,o}[n]$ to yield a weighted phase error signal. Each of the weighted error signals are combined by adders 758 and combined with the sum of the weights from each of the saturation detectors 756 for each harmonic phase tracker. The sum of the weights is inverted prior to combination with the sum of the phase error signals by inverter 760 in order to provide a normalizing factor for the summed phase error signal. The output of the multiplier 762 is the weighted phase error signal which is then combined with the tracker attenuation gain $g_0[n]$ and integrated to produce the estimated fundamental frequency $\hat{f}_o[n]$ for use in the demodulation of the input signal 702 as was described in accordance with the frequency locked loop tracker above.

Those ordinarily skilled in the art will recognize that any of the number of weighting schemes may be utilized in order to combine the individual phase error signals which result from each harmonic loop tracker. The particular inverse variance method selected should not be construed as limiting.

The input signal s[n] may include several voices, each comprising a fundamental partial signal and a set corresponding harmonics. The harmonics tracked by the set of parallel trackers in FIG. 7 can be resynthesized so as to regenerate one complete "voice". In one preferred embodiment, such resynthesis is accomplished using one instance of the resynthesis module (i.e., multiplier 402) shown in FIG. 4 for each of the trackers. Improved resynthesis is accomplished in a second preferred embodiment by providing one instance of the resynthesis module shown in FIG. 5 or FIG. 6 for each of the trackers in FIG. 7.

Those ordinarily skilled in the art will recognize that the harmonic loop tracker described in the preferred embodiment may also be used for tracking a well defined partial signal along with non-integer multiples of the fundamental frequency. This type of tracking known as inharmonic tracking is especially useful in tracking audio signals such as a piano, wherein sounds emanating from a piano are composed of stretched partials which are not integer multiples of a particular fundamental frequency. Inharmonic tracking is accomplished by defining a constant inharmonic ratio between the kth partial and the fundamental frequency. Such inharmonic frequency ratios may be supplied by a template or may be adaptively trained. In the preferred embodiment, the tracking of the inharmonic partials is the same with the exception that the kth demodulated signal must be computed explicitly, instead of in an iterative cascade, since the partials are no longer integer multiples of the fundamental frequency.

ALTERNATE EMBODIMENTS

Although the present invention has been described with reference to a few specific embodiments, the foregoing descriptions are illustrative of the invention and should not to be construed as limiting. Various modifications may occur to those skilled in the art without departing from the true spirit of the scope of the invention as defined by the appended claims.

For instance, the minimum-variance weighting method of the present invention could be used with a set of harmonically constrained peak detectors in an FFT-based pitch tracker.

What is claimed is:

1. A frequency-locked loop pitch tracker for tracking an input signal comprising:

demodulation means including a demodulation signal for demodulating said input signal resulting in a complex demodulated signal;

a low pass filter receiving said complex demodulated signal, said low pass filter for producing a filtered analytic signal;

means for detecting the rate of phase change of said filtered analytical signal and for producing a frequency tracking error signal;

an accumulator for receiving said frequency tracking error signal and outputting an estimated input signal frequency; and means for updating said demodulation signal responsive to said estimated input signal frequency;

said accumulator including an integrator for receiving said frequency tracking error signal and producing an integrator output signal, and a frequency-smoothing filter coupled to said integrator for receiving said integrator output signal and producing an improved frequency estimate signal.

2. The pitch tracker of claim 1 wherein said demodulation means comprises a multiplier for multiplying said input signal by the complex conjugate of a frequency-warping signal.

3. The pitch tracker of claim 1 wherein said means for measuring phase rate of change includes:

a multiplier stage for multiplying said analytic signal by its delayed conjugate; and means for measuring a phase difference of a resulting signal from said multiplier stage for producing a frequency tracking error signal.

4. The pitch tracker of claim 3 wherein said means for measuring a phase difference includes calculating the change in phase using a complex arctangent function.

5. The pitch tracker of claim 3 wherein said delayed conjugate is the conjugate of said analytic signal delayed by one sample.

6. The pitch tracker of claim 1 further including a resynthesizer, said resynthesizer including multiplier means for combining said demodulation signal with said filtered analytic signal to yield a resynthesized single partial target signal.

7. The pitch tracker of claim 6 further including a subtractor for removing said resynthesized single partial target signal from said input signal, said subtractor including a delay line for compensating for group delay in said low pass filter resulting in a delayed input signal; and a subtraction means having first and second inputs and a subtraction output, said subtraction means first input for receiving said delayed input signal and said subtraction means second input for receiving said resynthesized single partial target signal, such that said subtraction means generates a residual signal at said subtraction means output by removing said resynthesized single partial target signal from said delayed input signal.

8. The pitch tracker of claim 6 wherein said resynthesizer further includes a delay line, said delay line compensating for a group delay in said low pass filter, said delay line coupling said demodulation signal to said multiplier means.

9. The pitch tracker of claim 1 further including means for subtracting a resynthesized partial signal from said input signal, said subtraction means including:

a resynthesizer for resynthesizing a partial signal from said filtered analytic signal and said demodulation signal; and a subtractor for subtracting said resynthesized partial signal from said input signal.

10. The pitch tracker of claim 9 wherein said resynthesizer includes a multiplier means for combining said demodulation signal with said filtered analytic signal to yield a resynthesized single partial target signal.

11. The pitch tracker of claim 10 wherein said subtractor includes:

a delay line for compensating for group delay in said low pass filter resulting in a delayed input signal; and a subtraction means having first and second inputs and a subtraction output, said subtraction means first input for receiving said delayed input signal and said subtraction means second input for receiving said resynthesized single partial target signal, such that said subtraction means generates a residual signal at said subtraction means output by removing said resynthesized single partial target signal from said delayed input signal.

12. The pitch tracker of claim 1 further including phase-locked tracking means, said phase locked tracking means processing said filtered analytic signal using a complex phase detection function and producing a phase error signal, said phase error signal coupled to said means for updating said demodulation signal such that phase-locking is achieved.

13. The pitch tracker of claim 1 wherein said integrator includes addition means for combining at least two signals, said addition means receiving said frequency tracking error signal at a first input; and a delay line coupling said integrator output to a second input of said addition means.

14. The pitch tracker of claim 13 wherein said frequency-smoothing filter is a Kay filter.

15. The pitch tracker of claim 13 further including a resynthesizer, said resynthesizer including:

a second demodulation means including a second demodulation signal responsive to said improved frequency estimate signal for generating a second complex demodulated signal;

a second delay line for matching the group delays of said low pass filter and said Kay filter, said second delay line coupling said input signal to said second demodulation means;

a second low pass filter receiving said second complex demodulated signal, said second low pass filter for producing a second filtered analytic signal;

a third delay line receiving said second demodulation signal for producing a delayed second demodulation signal having a delay equal to the group delay of said second low pass filter;

multiplier means for combining said delayed second demodulation signal with said second filtered analytic signal for producing a resynthesized single partial target signal.

16. The pitch tracker of claim 15 further including a subtractor for removing said resynthesized single partial target signal from said input signal, said subtractor including a delay line for compensating for group delay in said low pass filter resulting in a delayed input signal; and a subtraction means having first and second inputs and a subtraction output, said subtraction means first input for receiving said delayed input signal and said subtraction means second input for receiving said resynthesized single partial target signal, such that said subtraction means generates a residual signal at said subtraction means output by removing said resynthesized single partial target signal from said delayed input signal.

17. The pitch tracker of claim 13 further including means for subtracting a resynthesized partial signal from said input signal, said subtraction means including:

a resynthesizer for resynthesizing a partial signal from said filtered analytic signal and said demodulation signal; and a subtractor for subtracting said resynthesized partial signal from said input signal.

18. The pitch tracker of claim 17 wherein said resynthesizer includes:

a second demodulation means including a second demodulation signal responsive to said improved frequency estimate signal for generating a second complex demodulated signal;

a second delay line for matching the group delays of said low pass filter and said frequency-smoothing filter, said second delay line coupling said input signal to said second demodulation means;

a second low pass filter receiving said second complex demodulated signal, said second low pass filter for producing a second filtered analytic signal;

a third delay line receiving said second demodulation signal for producing a delayed second demodulation signal having a delay equal to the group delay of said second low pass filter; and multiplier means for combining said delayed second demodulation signal with said second filtered analytic signal for producing an resynthesized single partial target signal.

19. The pitch tracker of claim 17 wherein said subtractor includes:

a delay line for compensating for group delay in said low pass filter resulting in a delayed input signal; and subtraction means having first and second inputs and a subtraction output, said subtraction means first input for receiving said delayed input signal and said subtraction means second input for receiving said resynthesized single partial target signal, such that said subtraction means generates a residual signal at said subtraction means output by removing said resynthesized single partial target signal from said delayed input signal.

20. A frequency-locked loop method for tracking an input signal comprising the steps of:

demodulating said input signal with a demodulation signal resulting in a complex demodulated signal;

filtering said complex demodulated signal with a low pass filter, said low pass filter for producing a filtered analytic signal;

detecting the rate of phase change of said filtered analytical signal to produce a frequency tracking error signal;

outputting an estimated input signal frequency responsive to said frequency tracking error signal; and updating said demodulation signal responsive to said estimated input signal frequency;

said outputting step including integrating said frequency tracking error signal to produce an integrator output signal, and filtering said integrator output signal with a frequency-smoothing filter to produce an improved frequency estimate signal.

21. The method of claim 20, wherein said demodulating step includes multiplying said input signal by a frequency-warping signal's complex conjugate.

22. The method of claim 20 further including combining said complex demodulated signal with said filtered analytic signal to yield a resynthesized single partial target signal.

23. The method of claim 22, further including removing said resynthesized single partial target signal from said input signal by:

generating a delayed input signal, and removing said resynthesized single partial target signal from said delayed input signal to as to generate a residual signal.

24. The method of claim 20 further including:

combining said demodulation signal with said filtered analytic signal to generate a resynthesized single partial target signal; and subtracting said resynthesized partial signal from said input signal to generate a residual signal.

25. The method of claim 20, further including the steps of:

combining said demodulation signal with said filtered analytic signal to yield a resynthesized single partial target signal;

generating a delayed input signal by delaying said input signal so as to compensate for signal delay associated with said filtering step; and subtracting said resynthesized single partial target signal from said delayed input signal to generate a residual signal.

26. A frequency-locked loop pitch tracker for tracking an input signal by tracking a plurality of harmonics in a harmonic signal representation of said input signal comprising:

a) a like plurality of frequency trackers, each of said frequency trackers for tracking one of said harmonics, each of said frequency trackers including demodulation means including a demodulation signal for demodulating said one of said harmonics resulting in a complex demodulated signal;

a low pass filter receiving said complex demodulated signal, said low pass filter for producing a filtered analytic signal;

means for detecting the rate of phase change of said filtered analytical signal and for producing a frequency tracking error signal;

wherein said plurality of frequency trackers are harmonically constrained such that each frequency tracker tracks a respective integer multiple of a fundamental frequency component of said input signal; wherein said each of said frequency trackers further includes a variance estimator for calculating the variance of said frequency tracking error signal;

b) means for weighting each of said frequency tracking error signals from each of said plurality of frequency trackers for producing a weighted frequency tracking error signal;

c) an accumulator for receiving said weighted frequency tracking error signals and outputting an estimated input signal frequency; and d) means for updating said demodulation signal responsive to said estimated input signal frequency.

27. The pitch tracker of claim 26 wherein said variance estimator derives the variance of said frequency tracking error signal according to the formula:

$$\overline{\epsilon}^2_k[n]=g_k[n]\overline{\epsilon}^2_k[n-1]+(1-g_k[n])\epsilon^2_k[n]$$

where $\overline{\epsilon}^2_k[n]$ is the variance estimate;

$\epsilon_k[n]$ is the frequency tracking error signal for kth harmonic, and $g_k[n]$ is the loop gain.

28. The pitch tracker of claim 26 wherein said weighting means further includes a saturation detector to limit the weighting of any frequency estimate due to a kth-tracker in cases where said variance estimate saturates.

29. The pitch tracker of claim 26 wherein said means for weighting includes:

a) weighting each of said frequency tracking error signals by the reciprocal of said variance calculated for each of said frequency tracking error signals; and b) summing all of the weighted frequency tracking error signals to yield said weighted frequency tracking error signal.

30. A pitch tracker for tracking an input signal by tracking a plurality of harmonics in a harmonic signal representation of said input signal comprising:

a) a like plurality of frequency trackers, each of said frequency trackers responsive to an estimated frequency signal for tracking one of said harmonics and producing a frequency tracking error signal; wherein said plurality of frequency trackers are harmonically constrained such that each frequency tracker tracks a respective integer multiple of a fundamental frequency component of said input signal; wherein said each of said frequency trackers further includes a variance estimator for calculating the variance of said frequency tracking error signal;

b) means for weighting each of said frequency tracking error signals from each of said plurality of frequency trackers for producing a weighted frequency tracking error signal; wherein each respective one of said frequency tracking error signals is weighted in accordance with the inverse of the variance of said respective frequency tracking error signal; and c) an accumulator for receiving said weighted frequency tracking error signals and outputting an updated estimated frequency signal such that each said frequency tracker tracks a corresponding one of said harmonics in accordance with said updated frequency estimate signal.

31. The pitch tracker of claim 30 wherein said variance estimator derives the variance of said frequency tracking error signal according to the formula:

$$\bar{\epsilon}^2_k[n]=g_k[n]\bar{\epsilon}^2_k[n-1]+(1-g_k[n])\epsilon^2_k[n]$$

where $\bar{\epsilon}^2_k[n]$ is the variance estimate;

$\epsilon_k[n]$ is the frequency tracking error signal for kth harmonic, and $g_k[n]$ is the loop gain.

32. The pitch tracker of claim 30 wherein said weighting means further includes a saturation detector to limit the weighting of any frequency estimate due to a kth-tracker in cases where said variance estimate saturates.

33. The pitch tracker of claim 30 wherein said means for weighting includes:

a) weighting each of said frequency tracking error signals by the reciprocal of said variance calculated for each of said frequency tracking error signals; and b) summing all of the weighted frequency tracking error signals to yield said weighted frequency tracking error signal.

34. A method for tracking an input signal by tracking a plurality of harmonics in a harmonic signal representation of said input signal comprising:

a) providing a like plurality of frequency trackers, each of said frequency trackers demodulating said input signal with a demodulation signal for tracking one of said harmonics; wherein said plurality of frequency trackers are harmonically constrained such that each frequency tracker tracks a respective integer multiple of a fundamental frequency component of said input signal;

b) deriving a frequency error tracking signal for each of said harmonics;

c) weighting each of said frequency tracking error signals from each of said plurality of frequency trackers for producing a weighted frequency tracking error signal;

d) outputting an estimated input signal frequency responsive to said weighted frequency tracking error signal; and e) updating said demodulation signal responsive to said estimated input signal frequency;

further including the step of determining the variance of said frequency tracking error signal for each of said harmonics, according to the formula:

$$\bar{\epsilon}^2_k[n]=g_k[n]\bar{\epsilon}^2_k[n-1]+(1-g_k[n])\epsilon^2_k[n]$$

where $\bar{\epsilon}^2_k[n]$ is the variance estimate;

$\epsilon_k[n]$ is the frequency tracking error signal for kth harmonic, and $g_k[n]$ is the loop gain.

35. A method for tracking an input signal by tracking a plurality of harmonics in a harmonic signal representation of said input signal comprising:

a) providing a like plurality of frequency trackers, each of said frequency trackers demodulating said input signal with a demodulation signal for tracking one of said harmonics; wherein said plurality of frequency trackers are harmonically constrained such that each frequency tracker tracks a respective integer multiple of a fundamental frequency component of said input signal;

b) deriving a frequency error tracking signal for each of said harmonics;

c) weighting each of said frequency tracking error signals from each of said plurality of frequency trackers for producing a weighted frequency tracking error signal;

d) outputting an estimated input signal frequency responsive to said weighted frequency tracking error signal; and e) updating said demodulation signal responsive to said estimated input signal frequency;

further including the steps of determining the variance of said frequency tracking error signal for each of said harmonics, and determining when said variance estimate saturates;

said weighting step including limiting the weighting of each frequency tracking error signal whose variance estimate saturates.

36. A method for tracking an input signal by tracking a plurality of harmonics in a harmonic signal representation of said input signal comprising:

a) providing a like plurality of frequency trackers, each of said frequency trackers demodulating said input signal with a demodulation signal for tracking one of said harmonics; wherein said plurality of frequency trackers are harmonically constrained such that each frequency trackers tracks a respective integer multiple of a fundamental frequency component of said input signal;

b) deriving a frequency error tracking signal for each of said harmonics;

c) weighting each of said frequency tracking error signals from each of said plurality of frequency trackers for producing a weighted frequency tracking error signal;

d) outputting an estimated input signal frequency responsive to said weighted frequency tracking error signal; and e) updating said demodulation signal responsive to said estimated input signal frequency;

further including the step of determining the variance of said frequency tracking error signal for each of said harmonics;

wherein said weighting step includes:

a) weighting each of said frequency tracking error signals by the reciprocal of said variance determined for each of said frequency tracking error signals; and b) summing all of the weighted frequency tracking error signals to yield said weighted frequency tracking error signal.

* * * * *